US005788089A

United States Patent [19]

Garfinkle

[11] Patent Number: 5,788,089

[45] Date of Patent: Aug. 4, 1998

[54] TAG MOLDING SUPPORT

[76] Inventor: Benjamin L. Garfinkle, 1120 Portal Ave., Piedmont, Calif. 94610

[21] Appl. No.: 369,712

[22] Filed: Jan. 6, 1995

Related U.S. Application Data

[63] Continuation-in-part of Ser. No. 125,522, Sep. 22, 1993, Pat. No. 5,402,897.

[51] Int. Cl.[6] ..... B42F 7/00

[52] U.S. Cl. ..... 211/59.1; 40/642; 211/57.1; 248/220.41

[58] Field of Search ..... 248/220.21, 220.41, 248/222.12; 211/59.1, 57.1; 40/642, 666

[56] References Cited

U.S. PATENT DOCUMENTS

| | | | |
|---|---|---|---|
| 4,463,510 | 8/1984 | Windish | 248/220.41 |
| 4,540,093 | 9/1985 | Merl et al. | 248/220.41 |
| 4,591,057 | 5/1986 | Garfinkle | 211/59.1 |
| 4,665,639 | 5/1987 | Fast | 211/59.1 |
| 5,088,606 | 2/1992 | Boas | 211/57.1 |
| 5,123,189 | 6/1992 | Fast et al. | 211/59.1 |
| 5,235,766 | 8/1993 | Fast et al. | 211/59.1 |

*Primary Examiner*—Ramon O. Ramirez
*Attorney, Agent, or Firm*—Malcolm B. Wittenberg

[57] ABSTRACT

An article support and display device for use with a support fixture. At least two spaced apart merchandise pegs are removably supported by the fixture at their proximal ends and have free distal ends for accepting and supporting merchandise for display. A planar sheet material acts as a baffle for residing proximate merchandise to be displayed and for supporting tag molding extending over the full width of the merchandise display.

9 Claims, 5 Drawing Sheets

TAG MOLDING SUPPORT

RELATED APPLICATIONS

The present application is a continuation-in-part of U.S. application Ser. No. 08/125,522 filed on Sep. 22, 1993, now U.S. Pat. No. 5,402,897, issued Apr. 4, 1995.

TECHNICAL FIELD OF THE INVENTION

The present invention deals with a device which is capable of supporting and displaying merchandise and related product identifying information within a supermarket or similar environment. The invention employs merchandise pegs and a baffle which supports molding for product identifying information. The present device can be employed using standard support fixtures which are commonly utilized in supermarket installations.

BACKGROUND OF THE INVENTION

The present invention relates to an article support and display apparatus for supporting articles of merchandise in display racks or cases and the like. Such displays are utilized in grocery stores and supermarkets and typically include peg bar support fixtures having apertures therein in which are removably inserted merchandise and molding support pegs for suspending and displaying merchandise for sale together with its product identifying information. Such devices are most common in refrigerator cases where luncheon meats and other prepackaged foods are displayed for sale although this is not the sole environment in which these devices can be found.

FIG. 1 depicts a typical article support and display device as described in U.S. Pat. No. 4,591,057. In employing such device, peg bar support fixture 1 having a substantially V-shaped cross-section is provided with cutout portions for releasably receiving molding support pegs 3 and merchandise support pegs 2. The molding support pegs being substantially S-shaped and having vertical extensions at their distal ends engage and support tag molding 4 through the use of slidable track clips. The molding support pegs 3 are provided in pairs for tag molding 4 which, in turn, are configured to slidably receive merchandise identification and pricing tags positionable proximate merchandise displayed for sale. The merchandise is, itself, supported on merchandise pegs 2 and, as shown in FIG. 1, tag molding 4 is positioned above and behind the distal ends of merchandise pegs 2 so that the merchandise offered for sale is not blocked from view by tag molding 4.

Yet another common iteration of a supermarket oriented merchandise display device is shown in FIG. 2. In this instance, a peg bar support fixture 5 is shown in the form of a tubular member having a substantially rectangular cross-section. Product identifying information is provided by a unitary molding support 6 which, at its proximal end, fits over support fixture 5 and, at its distal end, is provided with a turned-down section configured to receive product identifying information. As with the embodiment shown in FIG. 1, the display device of FIG. 2 is also intended to be provided with separate merchandise support pegs (not shown) which emanate from support member 5 below molding support 6. Obviously, hardware intended to be used with V-shaped peg bar support 1 cannot be employed with rectangular tubular member 5 of FIG. 2.

Although not depicted in any accompanying drawing, yet a further merchandise display device commonly employed in supermarket environments consists of a planar sheet of perf board having a regularly spaced array of holes configured therein. Merchandise support pegs and molding support pegs can be frictionally fit within holes contained in the perf board for product display. Again, such an arrangement is incompatible with the configurations shown in FIGS. 1 and 2 requiring different hardware and support apparatus in configuring an appropriate display.

As noted in parent U.S. application Ser. No. 08/125,522, it has also been found desirable to provide merchandise support and display installations of the type discussed herein with a baffle. A baffle is a shelf which can be employed generally above the merchandise being displayed, particularly when the display is found within a refrigerated supermarket deli case. The baffle is employed as an energy-saving device to aid in directing air flow within and about the refrigerated case in order to maintain the proper product temperature at a minimum of cost. When baffles are employed in installations such as those shown in FIGS. 1 and 2, a separate support configuration must be employed in addition to the merchandise and molding support pegs which does nothing but add to the cost and complexity of the installation. In addition, in some instances, if product location was to change, one would generally be required to reposition the baffle which is something which store clerks often times neglect.

It is thus an object of the present invention to provide an article support and display device wherein product and molding supports can be universally applied to all support structures commonly found in supermarket installations.

It is yet a further object of the present invention to provide an article support and display device which includes energy directing baffle means without adding to the complexity of the structure so employed.

It is yet a further object of the present invention to provide an article support and display device wherein energy directing baffle means can be employed to eliminate the need for separate molding support devices traditionally found in prior art configurations.

These and further objects will be more readily appreciated when considering the following disclosure and appended drawings wherein.

SUMMARY OF THE INVENTION

An article support and display device for use with a support fixture. The device comprises at least two spaced apart merchandise pegs removably supported by the support fixture at their proximal ends all having free distal ends for accepting and supporting merchandise for display. Planar sheet material is provided having proximal and distal ends and having a length greater than the distance between the spaced apart merchandise pegs and a width proximate the distance between the support fixture and the distal ends of the merchandise pegs. The planar sheet material is provided at its proximal end with at least one adapter means for attaching the planar sheet material to a support fixture to create a baffle and tag molding located at the distal edge of the planar sheet material for receiving and displaying product identifying information.

DETAILED DESCRIPTION OF THE INVENTION

Figure 3:
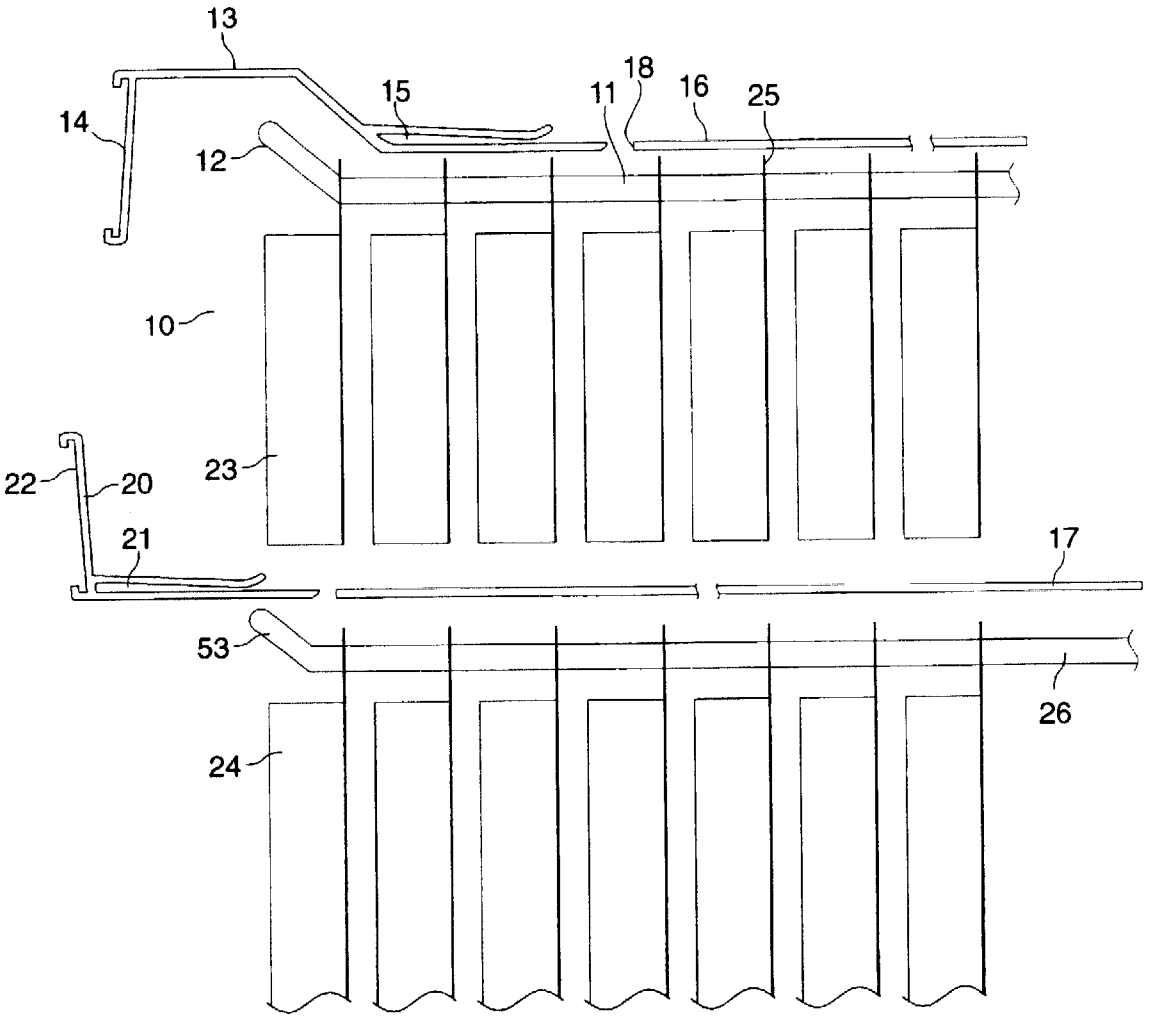
PRIOR ART FIG. 3
FIG. 3 is a side plan view of the article support and display device as disclosed and claimed in parent U.S. application Ser. No. 08/125,522.

The invention disclosed and claimed in parent U.S. application Ser. No. 08/125,522 is depicted in FIG. 3. Specifically, merchandise pegs 11 and 26 extend substantially horizontally from suitable peg bar support fixtures (not shown) and are supported by them at their proximal ends although the distal ends 12 and 53 are slightly upturned for the receipt of generally prepackaged merchandise 23 and 24. The merchandise can be stacked along merchandise pegs 11 and 26 as shown for ready removal by consumers wishing to purchase such products. Baffles 16 and 17 are generally configured of substantially transparent plastic sheets having distal edge 18. Ideally, the baffles have a thickness of approximately 0.05 inches which allows for flexibility as the tag molding is lifted and yet is rugged enough to insure long life.

Applicant's parent application discloses that baffle 16 is frictionally engageable by tag molding support 13 at its distal edge 18. Baffle 16 is inserted within U-shaped track 15 of molding support 13 so that the molding support will resist inadvertent dislodgement from baffle 16 which can be easily removed therefrom in the event that a change is deemed necessary by the display clerk. Upon installation, molding support 13 provides for molding 14 to receive product identifying information forward and above merchandise 23.

As noted from a further review of applicant's parent U.S. application Ser. No. 08/125,522, various baffle means were configured as shown in FIG. 3 and elsewhere as comprising planar sheet material 16 and 17, employing various adapters shown in FIGS. 4 through 6 and tag molding such as molding 14 and 22 of FIG. 3. Adapters to connect various baffles to support fixtures were generally provided each adapter being located on the proximal edge of each baffle for structural support.

It has now been determined that such various multi-component structures as recited above and which constituted the disclosure of applicant's parent U.S. application Ser. No. 08/125,522 may not provide the most ideal configuration from the standpoint of product integrity and stability.

Figure 1:
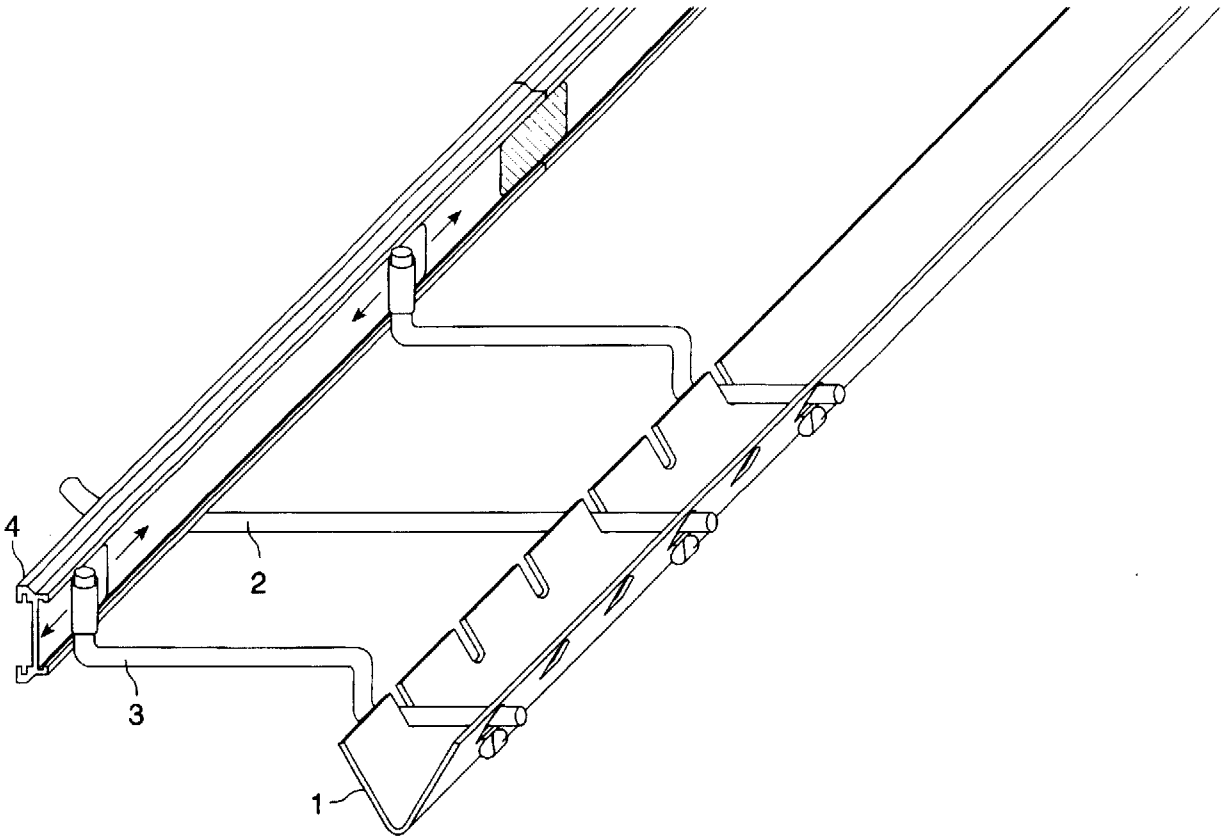
PRIOR ART FIG. 1
FIGS. 1 and 2 represent prior art as discussed above.
Figure 2:
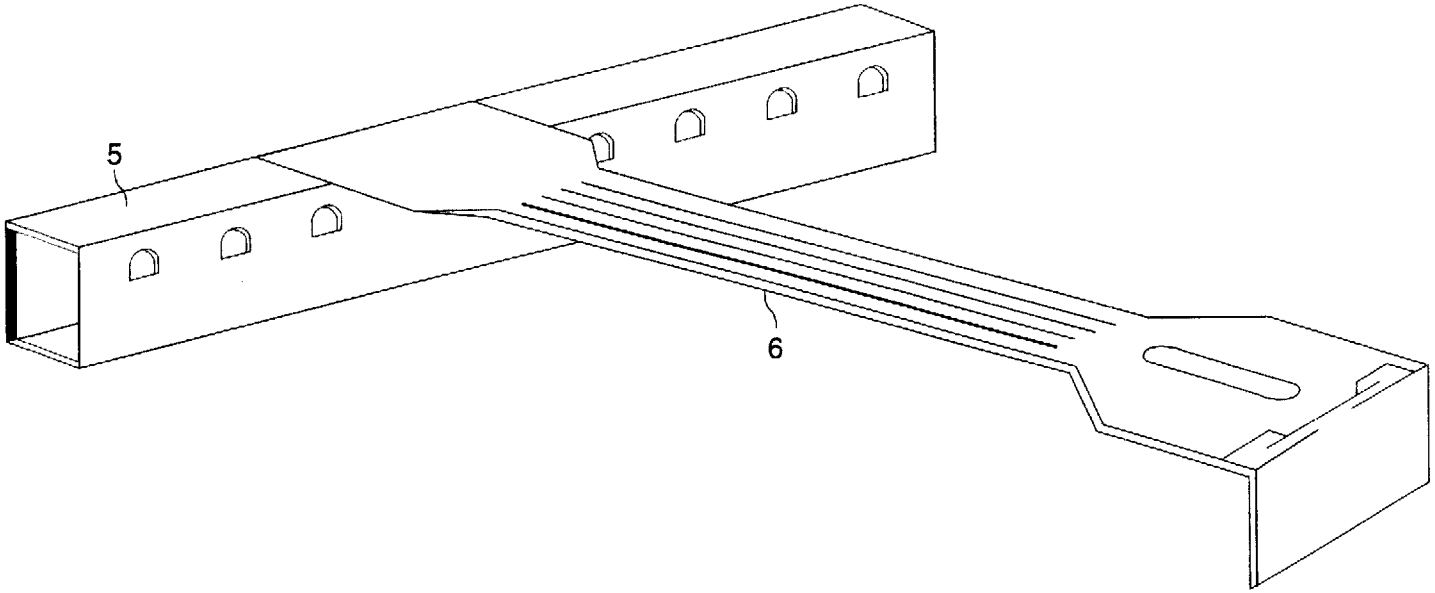
PRIOR ART FIG. 2
Figure 4:
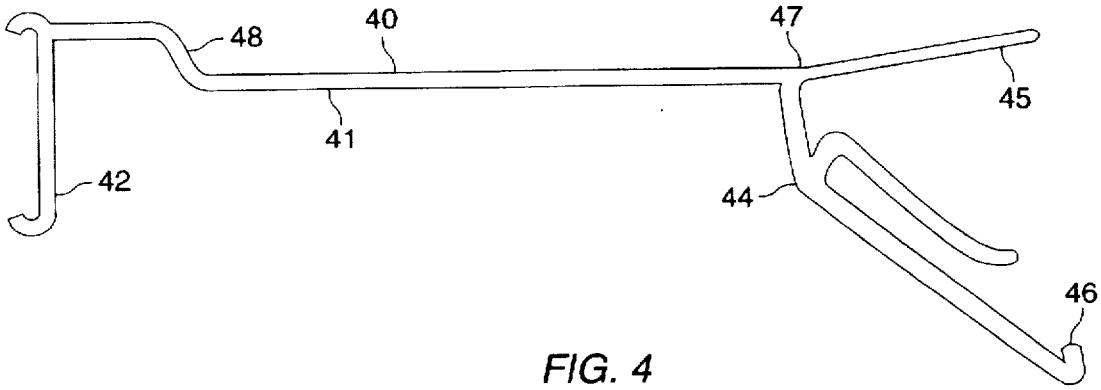
FIGS. 4, 5 and 6 are side plan views of various baffle arrangements useful in practicing the present invention.
Figure 5:
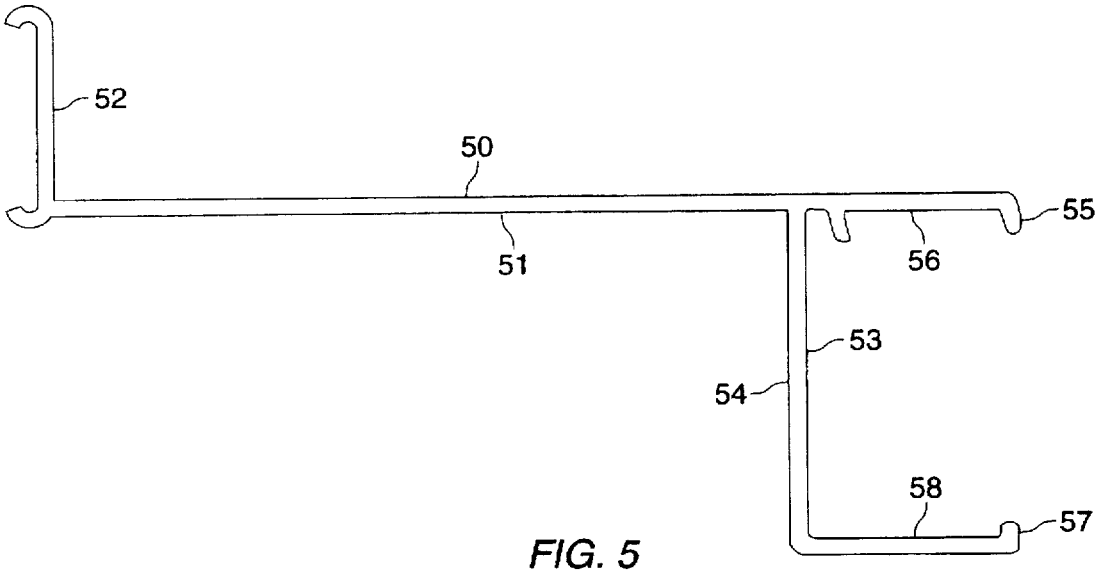
Figure 6:
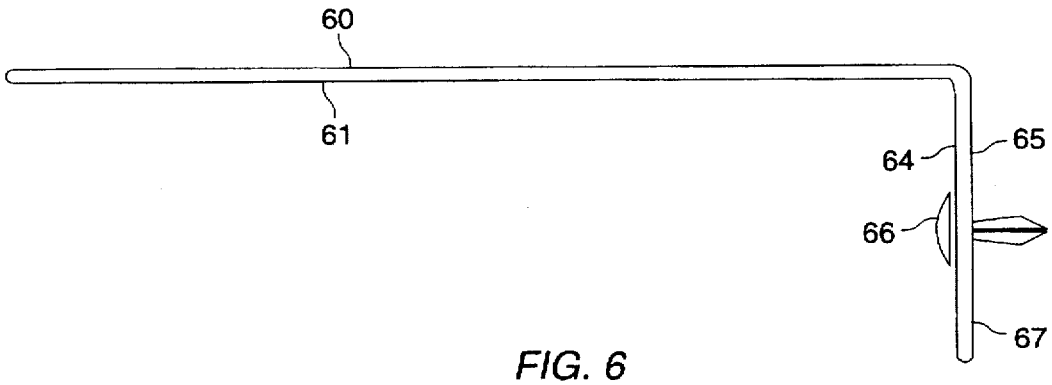

In this regard, reference is made to FIGS. 4, 5 and 6 wherein various embodiments of the present invention are presented. In FIG. 4, a unitary baffle structure 40 is provided having planar sheet material 41 having proximal and distal edges 47 and 48, respectively. Adapter 44 has been configured as a continuum of planar sheet material 41 such that adapter 44 which is located at the proximal edge 47 of planar sheet material 41 is permanently joined to planar sheet material 41 as a unitary part. Adapter 44 is made for engaging V-shaped peg bar support 1 (FIG. 1). As such, adapter 44 is provided with hooked lip 46 which precedes over and encompasses the apex of the V-shaped member 1 such that top surface 45 maintains a substantially horizontal orientation so that planar sheet material can extend therefrom in a horizontal fashion.

As noted, distal end 48 of planar sheet material 41 terminates in tag molding 42. As was the case with adapter 44, tag molding 42 can be configured as a unitary structure with planar sheet material 41 such that the tag molding is permanently joined to the planar sheet material as a unitary part.

Yet another embodiment of the present invention is shown in FIG. 5 whereby baffle 50 comprised of planar sheet material 51 terminates, again as a unitary structure by adapter 54 at the baffle's distal end and by tag molding 52 at its distal end. The embodiment shown in FIG. 5 differs from that of FIG. 4 in providing further examples of alternative configurations for both the adapter and tag molding. Specifically, adapter 54 has a general rectangular cross-section for capturing peg bar support structures which, themselves, are generally rectangular in cross-section. As such, horizontal legs 56 and 58 in conjunction with vertical leg 53 are intended to frictionally fit over and be retained on a suitable rectangular peg bar making use of lips 55 and 57. Frictional fit between adapter end 54 and a suitable peg bar substantially prevents inadvertent removal from the peg bar although intentional removal is straight forward by simply prying lips 55 and 57 from the rectangular cross-section of the peg bar. Once again, as noted in FIG. 5, planar sheet element 51 has been configured with adapter 54 as a unitary element. Similarly, tag molding 52 has been configured with planar sheet material 51 as a unitary element. Tag molding 52 differs from tag molding 42 of FIG. 4 in that it is intended to extend above rather than below the plane established by planar sheet material 51. In this configuration, baffle 50 is generally located below corresponding merchandise for product identification.

FIG. 6 illustrates baffle 60 comprised of planar sheet material 61 which terminates at its proximal edge with adapter means 64, again, as a unitary or continuous extension of planar sheet material 61. Adapter 64 is provided with vertically extending leg 67 which forms a right angle with planar sheet material 61. It is noted that rivet 66 is caused to pass through vertically extending leg 67 and is configured to extend within an opening found in a perf board (not shown). As such, flexibility of the placement of adapter 64 can be conveniently realized by enabling the adapter to vertically move within various perf board openings to fine tune the placement of the baffle.

FIG. 6 has been drawn without employment of a contiguous or unitary tag molding. This was done to illustrate the flexibility of the present invention such that in the embodiments shown in FIGS. 4, 5 and 6, it is not necessary, while keeping within the spirit and scope of the present invention, to employ both unitary and contiguous adapters and tag molding elements. In other words, the present invention contemplates the use of either contiguously formed tag molding and/or adapters.

Furthermore, unlike the invention disclosed and claimed in parent U.S. application Ser. No. 08/125,522, it is contemplated that a single adapter such as adapter 44, 54 or 64 be configured with their respective planar sheet material to create a suitable baffle as a single contiguous running element rather than as individually configured adapters proximate the corners of each planar sheet element. In other words, the only constraint in determining the running dimension of a suitable adapter is that it be configured to append to an appropriate support fixture and fixedly retain the appended planar sheet material to prevent inadvertent removal thereof during use of the baffle element.

Figure 7:
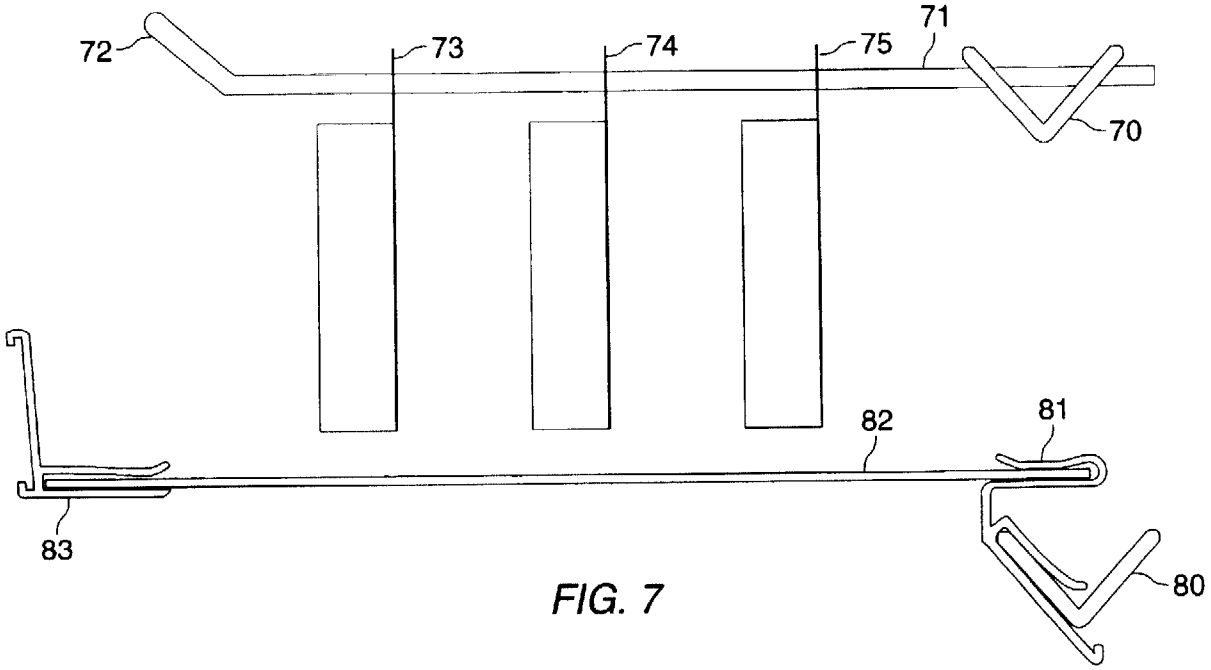
FIG. 7 is an side plan view of yet a further embodiment of the article support and display device of this invention.

It is further noted that although a suitable baffle and merchandise pegs are intended to be used in conjunction with one another, there is no requirement that each of these elements emanate and be supported by a single support fixture. To illustrate this point, reference is made to FIG. 7 wherein a vertical row of horizontally aligned support fixtures 70 and 80 are provided for the display of prepackaged merchandise 73, 74 and 75. Such merchandise is supported by merchandise peg 71 having upturned distal end 72 and being supported at its proximate end by support fixture 70.

Support fixture 80, located vertically below support fixture 70, supports planar sheet element 82 through the use of adapter 81 as shown. At the distal end of planar sheet element 82 is located tag molding 83 which is intended to display product identification and pricing information pertaining to prepackaged merchandise 73, 74 and 75. By placing the baffle structure below the related merchandise, a consumer is able to readily relate the product identification and pricing information with respect to the specific product for sale while being able to conveniently remove the merchandise over upturned end 72 while avoiding having to negotiate around tag molding 83. Further, as noted previously, the configuration shown in FIG. 7 provides complimentary merchandise pegs and baffle elements which emanate from different support fixtures.

It is noted that the present invention is not limited to any particular commonly available peg bar support structure. It is further not limited to the deli or refrigerated section of the supermarket. The present invention can be used in displaying such diverse items as packaged candy, Mexican spices and packaged nuts. In other words, it can be used anywhere that commonly sized packages are displayed on hooks.

It is also contemplated that baffles of various sizes be made available to the user of the present invention. The width of the baffle is a variable that allows price tag molding to emanate forward of the distal end of the merchandise pegs. The length of the baffle generally extends the distance between the extreme merchandise pegs provided in the installation.

I claim:

1. An article support and display device for use with a support fixture comprising at least two spaced apart merchandise pegs removably supported by said support fixture at their proximal ends and having free distal ends for accepting and supporting merchandise for display, planar sheet material having proximal and distal edges and having a length greater than the distance between said spaced apart merchandise pegs and a width proximate the distance between said support fixture and the distal ends of said merchandise pegs, said planar sheet material being provided, at its proximal edge, with at least one adapter means for attaching said planar sheet material to a support fixture to create a baffle and tag molding located at the distal edge of said planar sheet material for receiving and displaying product identifying information.

2. The article support and display device of claim 1 wherein said baffle comprises a planar sheet material permanently joined to said adapter means as a unitary part.

3. The article support and display device of claim 1 wherein a single adapter is located at the proximate edge of said planar sheet material for attachment of said planar sheet material to said support fixture.

4. The article support and display device of claim 1 wherein said tag molding is permanently joined to said planar sheet material as a unitary part.

5. The article support and display device of claim 1 wherein said tag molding and adapter means are permanently joined to said planar sheet material as a unitary part.

6. The article support and display device of claim 1 wherein said adapter means is permanently joined to said support fixture as a unitary part.

7. An article support and display device for use with first and second support fixtures being horizontally aligned in a vertical row comprising at least two spaced apart merchandise pegs removably supported by said first support fixture at the proximal end of said merchandise pegs, said merchandise pegs further having free distal ends for accepting and supporting merchandise for display, planar sheet material having proximal and distal edges and having a length greater than the distance between said spaced apart merchandise pegs and a width proximate the distance between either of said support fixtures and the distal ends of said merchandise pegs, said planar sheet being provided, at its proximal edge, with at least one adaptor means for attaching said planar sheet material to said second support fixture to create a baffle and tag molding located at the distal edge of said planar sheet material for receiving and displaying product identifying information.

8. The article support and display device of claim 7 wherein said baffle is supported by a support fixture located below the support fixture supporting said merchandise pegs.

9. The article support and display device of claim 7 wherein said baffle is supported by a support fixture located above the support fixture supporting said merchandise pegs.

* * * * *